United States Patent [19]

Thomann et al.

[11] Patent Number: 4,621,939

[45] Date of Patent: Nov. 11, 1986

[54] DRAINAGE CHANNEL

[75] Inventors: Roland Thomann, Langnau; Heinz Witschi, Adligenswil; Heinz-Dieter Brink, Mattstetten; Markus Amann, Langnau, all of Switzerland

[73] Assignee: Polydrain, Inc., Troutman, N.C.

[21] Appl. No.: 553,592

[22] Filed: Nov. 21, 1983

[30] Foreign Application Priority Data

Nov. 23, 1982 [CH] Switzerland ..... 6826/82
Oct. 18, 1983 [CH] Switzerland ..... 5662/83

[51] Int. Cl.[4] ..... E01C 11/22

[52] U.S. Cl. ..... 404/4; 404/5; 404/26; 52/98; 52/707; 49/465; 137/371; 210/164

[58] Field of Search ..... 404/2-5, 404/26; 52/20, 21, 169.5, 98, 100, 704, 707, 710; 49/465; 292/260, 256.71, 256.73; 210/163, 164; 137/364, 371

[56] References Cited

U.S. PATENT DOCUMENTS

| | | | |
|---|---|---|---|
| 1,324,981 | 12/1919 | Roesch | 292/260 |
| 2,185,669 | 1/1940 | Isenhour | 52/100 |
| 2,993,600 | 7/1961 | Ressler | 210/164 |
| 3,240,133 | 3/1966 | Ross | 404/26 |
| 3,319,384 | 5/1967 | Berg | 52/710 X |
| 3,418,781 | 12/1968 | Penote | 52/704 X |
| 3,561,307 | 2/1971 | Mortensen | 52/707 X |
| 3,860,089 | 1/1975 | Huggett | 52/710 X |
| 4,040,211 | 8/1977 | Wotherspoon | 52/100 |
| 4,110,942 | 9/1978 | Slocomb, Jr. | 52/100 |

FOREIGN PATENT DOCUMENTS

| | | | |
|---|---|---|---|
| 2844748 | 4/1979 | Fed. Rep. of Germany | 210/163 |
| 1430358 | 1/1966 | France | 404/2 |
| 658097 | 10/1951 | United Kingdom | 404/4 |

*Primary Examiner*—James A. Leppink
*Assistant Examiner*—John F. Letchford
*Attorney, Agent, or Firm*—W. Thad Adams, III

[57] ABSTRACT

The drainage channel comprises a channel body (1), cast frame (2) and cast grid (3). The support surface of the side walls (11) of the channel body (1) are of stepped construction, with a raised external supporting rib (13). The frame (2) is rectangular, with a lowered support rail (28) as support for the side ribs (30) of the grid (3). On the outside the frame (2) has detachably fastened brake lugs (23), which in the installed state prevent displacement of the frame (2). Locking bar holders (44) of roughly H-shaped cross-section are disposed in the side walls (11) some distance below the support surface. These locking bar holders form a closure between the interior of the channel body and the exterior. On the inside a side wall (79) forms an obtuse angle with the wall (75), so that the locking bar (45) can easily be turned into the inner recess (78). A drainage channel of this kind can easily be adapted to the different heights in the case of stepwise laying of the base course and cover layer, and it can be cast in a simple manner in polyester concrete. At the same time it also has a plurality of anchoring ribs at the side of the retaining lugs, thus ensuring good anchorage in all directions.

2 Claims, 8 Drawing Figures

DRAINAGE CHANNEL

Figure 1:
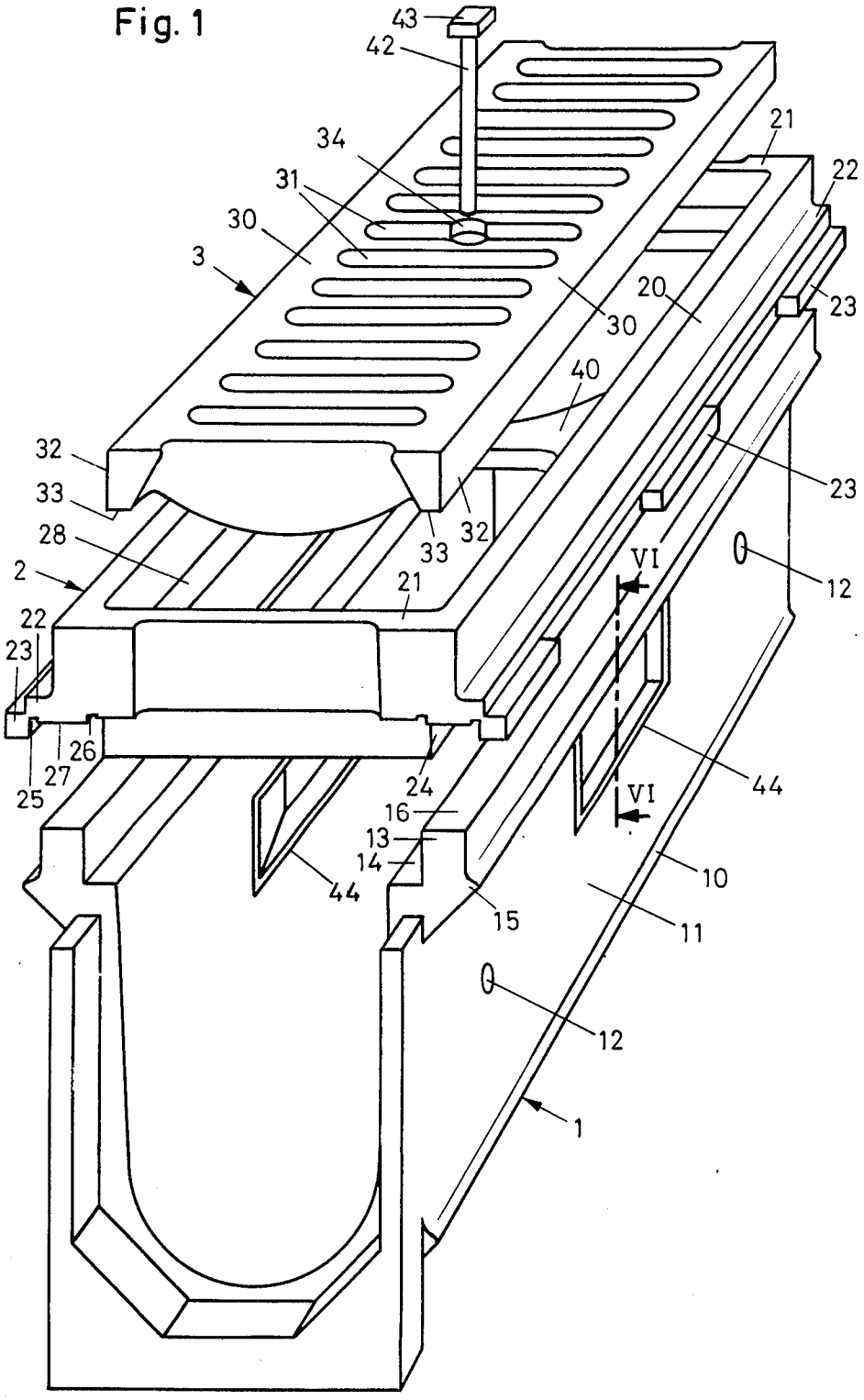

The present invention relates to a drainage channel with a U-shaped channel body and grids adapted to be inserted into frames closed on four sides, in which channel body the side walls are constructed with cutouts for receiving locking bars, each of which holds a grid locked and which are rotatably fastened on the said grid, while in addition the support surfaces of the side walls for the frame are of stepped construction with a raised external supporting rib and a lowered internal shaped shoulder, and the frame being provided with support rails, which are disposed alongside and lowered in relation to the edge, for supporting side ribs of the grid.

A drainage channel of this kind is for example illustrated and described in DE-A-2,844,748. A cast frame closed on four sides is disposed on a U-shaped channel body, preferably of plastic concrete, and in turn carries the inserted cast grid. The channel body has cutouts which lie opposite one another in the side walls and which are situated at a distance from the support surfaces for the cast frame, while their top side is in the form of a locking surface. Below the grid is disposed a locking bar, which is pivotably fastened on the grid by means of a screw connection, so that its ends are pivoted to a position under the locking surface of the cutouts and are held there by means of the screw connection by clamp fastening.

Fastenings of this kind are themselves part of the prior art; thus, in FR-A-2,328,805 a cover for a cleaning access hole in sewers is described, in which a ring is drawn against the cover by means of a screw, so that an elastic seal lying between the cover and the ring is pressed against the wall of the opening.

Similarly, in U.S. Pat. No. 1,400,399 it is proposed that on a circular cover for a cistern two closure rods should be pushed into cutouts in the wall by means of a rotary movement from the top face of the cover.

Whereas in the first-mentioned publication, DE-A-2,844,748, provision was in addition made for these openings merely to be marked by weakened points in the side wall and to be hammered out for the purpose of use, cutouts of this kind in the inner walls are also known from U.S. Pat. No. 1,400,399, which has also been mentioned above.

In a drainage channel according to DE-A-2,844,748 as mentioned, the frame has bevelled surfaces on the outside, of such a kind that through the consequent tapering it is at least made difficult for the frame to be pulled out of the foundation. This however entails the disadvantage that the jointing is made wedge-shaped, so that the concrete of the coating surface can break out at the edge. The two short sides of the frame give the latter the necessary inherent strength as an individual component and serve to fasten the grids, which are thus unable to move either in the longitudinal direction or in the transverse direction. When a wearing layer is subsequently applied, the frame can thus also be exposed and mounted at a new level.

It has however been found that the side guide lugs lying externally against the channel body may lead to difficulties in the case of stepwise application of the layers, because in that case a groove must be kept free or cut out at least at the side of the support surface.

Unless provision was originally made for fastening of the grids, it was often no longer possible to break out the openings, or they had to be chiselled out laboriously.

In the case of motorways or similar highways where there is heavy traffic, a part is often freed for traffic, for example for works traffic. This occurs when only the lower base course has been applied. When it is then desired to permit road traffic in a second release stage, this is generally done when the upper base course has been laid. However, an upper base course of this kind may have a thickness of up to 10 centimeters or sometimes more. This can then no longer be equalized by simply raising the frame. Even if the frame can be mounted on the upper base course for the purpose of applying the final road surface, this entails the previously mentioned disadvantages with regard to the guide lugs.

One object of the invention is therefore that of improving a drainage channel of the type described, in such a manner that it meets all requirements in respect of loadability, simplicity of installation, and cost of manufacture and installation.

According to the invention this is achieved in when the frame is provided with a plurality of retaining lugs which engage externally over the supporting ribs of the two side walls, project from the frame and are detachably connected to the latter, and when, for the purpose of receiving and locking the ends of the locking bars, locking bar holders are disposed in the side walls.

Particularly advantageous embodiments of this invention are characterized in the dependent claims.

Figure 2:
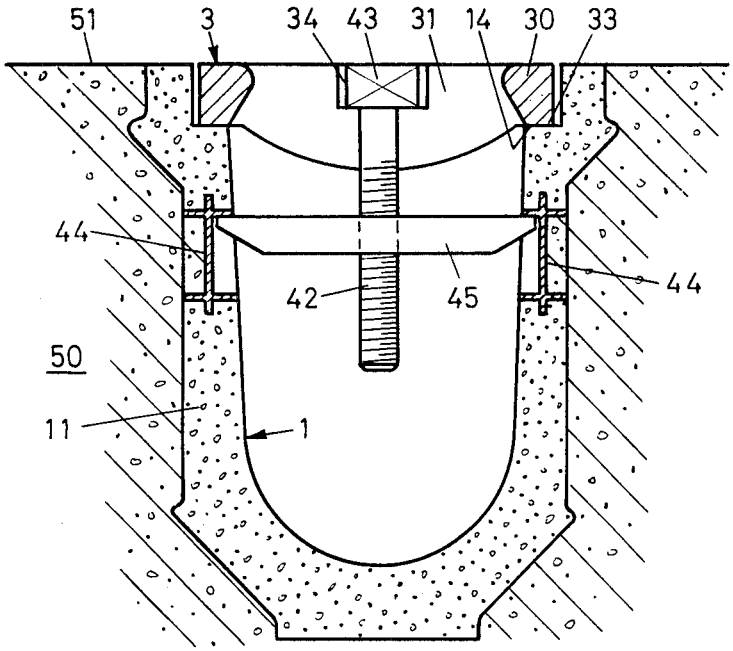
Figure 3:
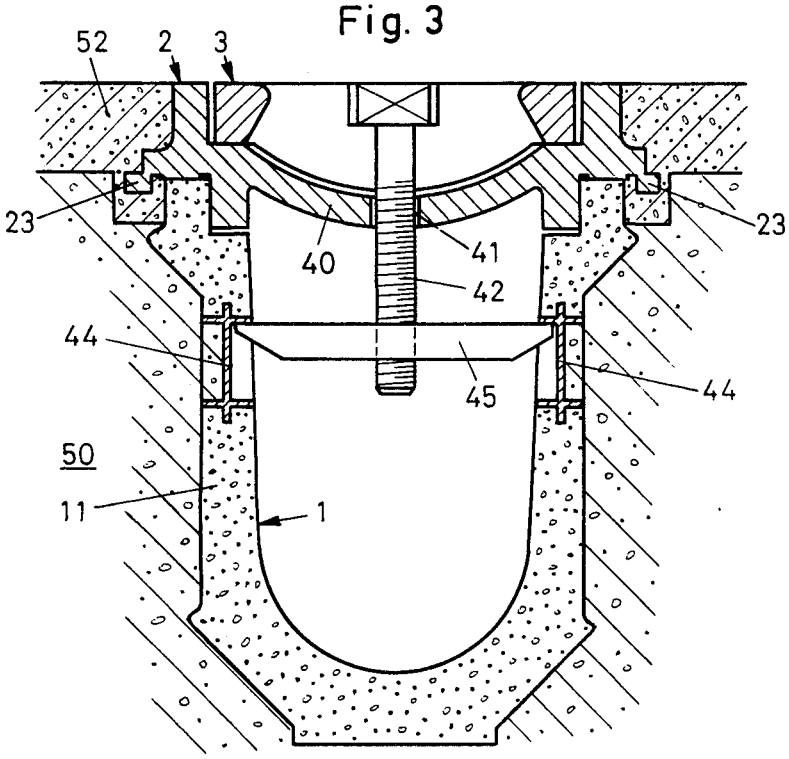
Figure 4:
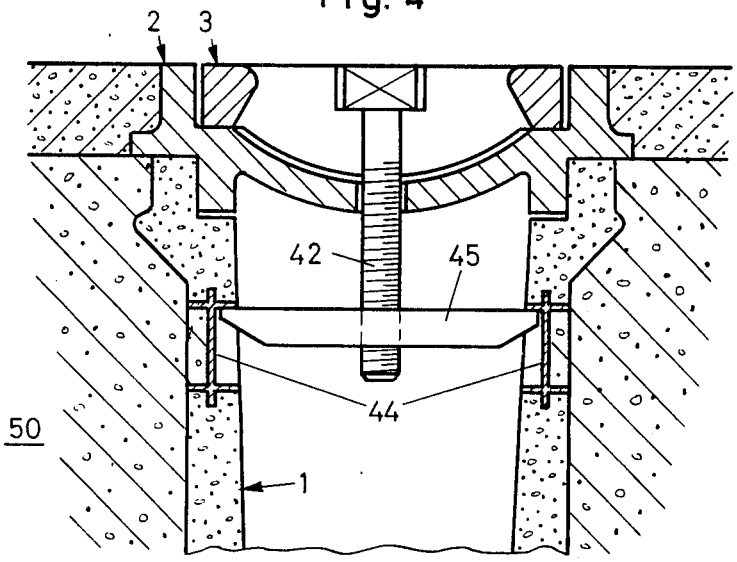
Figure 5:
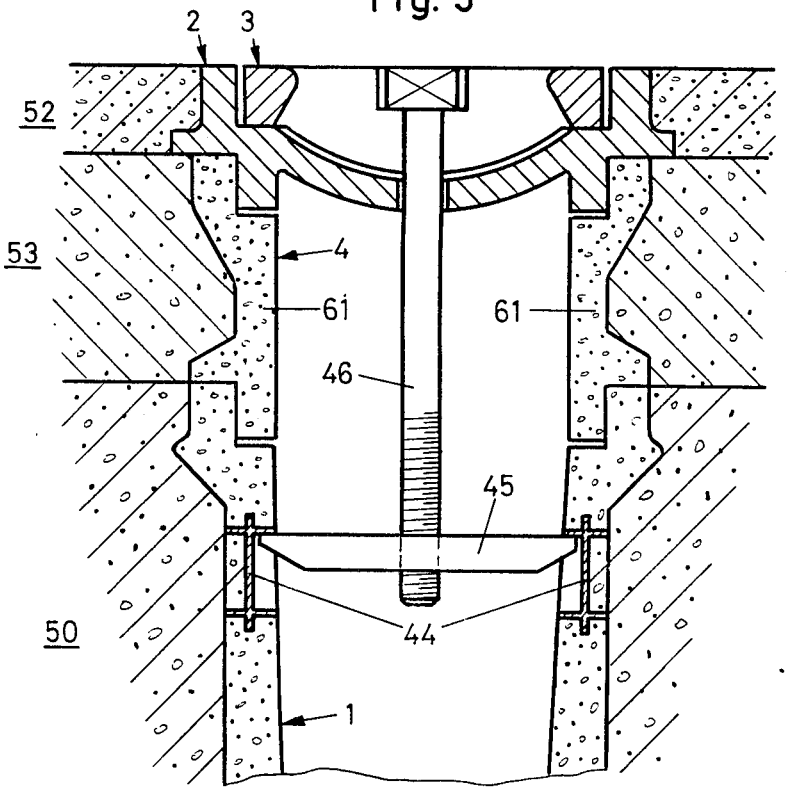

The invention is explained below with the aid of the drawing, in which:

FIG. 1 is an exploded perspective view of a drainage channel according to the invention, FIG. 2 is a sectional view taken transversely to the longitudinal axis of the drainage channel shown in FIG. 1, installed in a highway at the height of the upper base course, but with an inset grid, and without the frame FIG. 3 is a sectional view similar to FIG. 2, with the frame mounted, installed in the highway provided with a cover layer, FIG. 4 is a sectional view similar to FIG. 3, but with the break lugs removed, FIG. 5 is a similar sectional view to FIG. 3, but with the break lugs removed and relates to three-stage installation, the highway being utilizable as soon as the lower base course has been laid.

Figure 6:
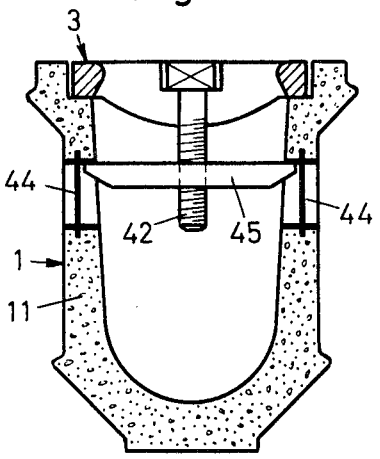
Figure 7:
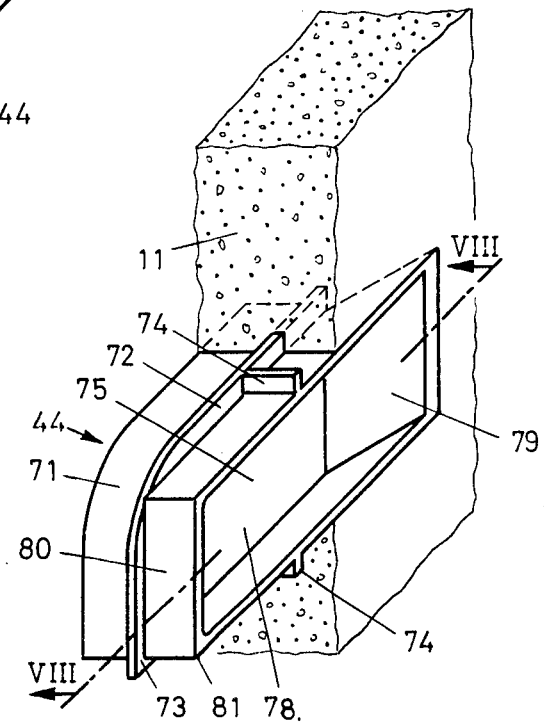
Figure 8:
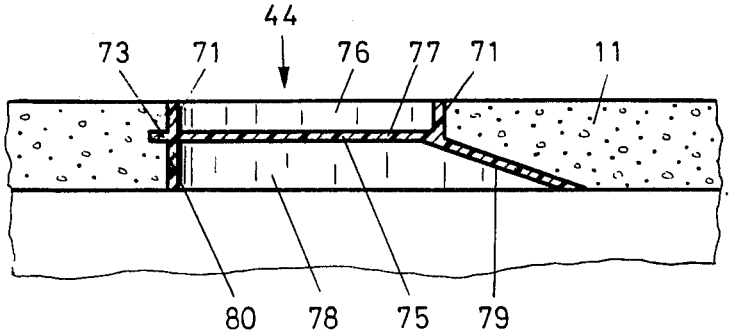

FIG. 6 is a sectional view of a drainage channel, taken on the sectional line VI—VI in FIG. 1 to illustrate the locking point, but with an inset grid and without the frame, FIG. 7 is a perspective view of an inserted locking bar holder, and FIG. 8 is a sectional view on the sectional line VIII—VIII in FIG. 7.

In FIG. 1 the different parts of a drainage channel are clearly visible, namely a channel body 1, a frame 2, and a grid 3. The channel body is cast in one piece in polyester concrete, and has lateral anchoring ribs 10 serving for better anchoring in the foundation. In the side walls 11 are also situated openings 12, which are marked by weakened points and through which, after the part of the wall has been broken out, a known anchoring dowel can be inserted, in order thereby to achieve additional anchorage.

An increase in strength can be obtained with the aid of the frame 2 mounted on the channel body 1, which at the same time protects the edges of the channel body 1.

The support surface on the side walls 11 for the frame 2 is of stepped construction, with a raised external supporting rib 13 and a lowered internal shaped shoulder 14. An additional lateral anchoring rib 15 is provided on the lower edge, projecting beyond the side wall 11, of the supporting rib 13.

The frame 2 comprises two side frame parts 20 and two webs 21 joining together the ends of the frame parts 20. These webs 21 give the frame 2 the necessary inherent strength and ensure that the grids 3 are held fast in the longitudinal direction. On the outside the frame parts 20 are provided with a bottom lateral rib 22, to which outwardly projecting break lugs 23 are integrally joined. The lower faces of the frame parts 20 have respective grooves 25 and 26 at the transition to the holding lugs 23 and at the stepped guide part 24 of the frame parts 20. The outer groove 25 forms a notch at the break lugs 23, so that the latter can be separated if necessary, as will be described later on. The two grooves 25,26 are formed through the fact that the convex portion 27 between the two grooves is formed by a ground-in depression in the casting mold, and they now serve for a claw action in integrally cast frames. The holding lugs 23 prevent displacement of the frame 2 in the longitudinal direction.

The outer surface of the frame part 20 is at least approximately vertical, and the top surface of the side rib 2 is at least approximately horizontal, while the transition part is rounded. Thus the cover layer of the highway can be made up to the frame 2, and it is not necessary to insert an expensive joint band entailing time-consuming labor.

Finally, the grid 3 has in known manner elongated openings 31 disposed transversely to the longitudinal axis and lying between two side ribs 30. The outer surfaces 32 of the side ribs 30 are likewise at least approximately vertical, and the bottom support surfaces 33 are horizontal in order to rest on the lowered support rails 28 of the frame 2.

A web 40 in the frame 2 is situated roughly centrally under the grid 3 and has a through hole 41 (FIGS. 3 to 5) for the purpose of fastening the grid 3 by means of a threaded bolt 42. The head 43 of the threaded bolt 42 is countersunk in a depression 34 in the grid 3. Under the web 40 is disposed a locking bar 45 screwed onto the threaded bolt 42 (FIGS. 3 to 5). The ends of the locking bar 45, after being turned, engage in the locking bar holders 44 in the side walls 11, in order to fasten the grid 3 and the frame 2 on the channel body 1. The locking bar holders 44 will be discussed in greater detail further on.

FIGS. 2 to 5 are cross-sectional views of differently installed drainage channels according to the description given so far. Identical parts are given the same reference numerals. The channel body 1 is accordingly cast in a concrete shoulder 50. Any dowels used are not shown in the drawings. The hot-mix base-course 51 is flush with the support surface 16 of the supporting rib 13. If the lowering of the shaped shoulder 14 is now equal to that of the support rail 28 in relation to the surface of the frame part 20, a grid 3 inserted therein likewise lies flush with the hot-mix base-course 51. By means of the threaded bolt 42 the locking bar 45 can now be turned so as to come into engagement with the two locking bar holders 44, and the grid 3 can be fastened by tightening the threaded bolt 42.

If then subsequently, as shown in FIG. 3, a cover layer 52 is applied over the shoulder 50, the frame 2 can be mounted on the channel body 1 instead of the grid 3. If the shoulder 50 can be cut out next to the channel body 1, or if a joint band was inserted into the shoulder 50 before application of the cover layer 52, the frame 2 together with the brake lugs 23 can be inserted; otherwise, as illustrated in FIG. 4, the break lugs 23 must be separated from the frame 2. Because of the groove 25, this separation can be effected in a simple manner with the aid of a hammer, by blows applied to the break lugs 23 from above.

The web 40 of the frame 2 is provided with a threaded hole 41, as already mentioned. The threaded bolt 42 is thus pushed through the web 40 and screwed into the locking bar 45. The grid 3 can thus be fastened on the frame 2, and these two parts together are then rigidly connected to the channel body 1 by means of the locking bar 45 and the locking bar holder 44.

FIG. 5 illustrates the case where an upper base course 53 is applied to the shoulder 50, and the cover layer 52 is then applied to this base course 54. In order to make the highway utilizable, the grid 3 can first be mounted directly on the channel body 1, as shown in FIG. 2.

An intermediate frame 4, which can be mounted on the support surface on the channel body 1 and which at the top has a similar support surface to that of the channel body 1, serves to bridge over the extra height. The intermediate frame 4 may be in the form of a casing closed on four sides, or it may have two side walls 61 joined by transverse ribs. Before the cover layer 52 is laid, the frame 2 shown in FIGS. 3 or 4 can be fitted, and by means of a longer threaded bolt 46 the channel body 1, the mounting element 4, the frame 2 and the grid 3 are connected together in the manner previously described.

FIG. 6 shows a sectional view on the line VI—VI in FIG. 1, that is to say through the locking bar holders 44. The channel body 1 with the inset grid 3 can be seen once again; the threaded bolt 42 has been screwed into the locking bar 45, and the ends of the locking bar 45 lie against the top surface of the locking bar holder 44.

FIG. 7 shows an example of embodiment of a locking bar holder 44 integrally cast in a side wall 11. In order to ensure that the locking bar holders 44 will be anchored in such a manner that they will resist any action tending to tear them out, the surfaces 71 lying in the channel body 1 are provided with ribs 72 and 73. It is however obvious that other suitable convex or concave constructions for these surfaces can also serve this purpose.

As clearly shown in FIG. 8, the locking bar holder 44 has a roughly H-shaped profile, an external frame 78 and a wall 75 being distinguishable. This external recess 76 in the locking bar holder 44 is asymmetrical in shape.

The effect is thus achieved that the locking bar holder 44 will always be inserted into the casting mold with the correct orientation. The outer surface 77 of the wall 75 is suitable for carrying a mark or manufacturer's name.

The locking bar holder 44 can simply be incorporated during the casting of the channel body 1. For this purpose the locking bar holders 44 are each placed with their external recesses 76 on a boss in a casting mold, and the channel body is cast in this mold.

The inner recess 78 is preferably provided with a side wall 79 forming an obtuse angle with the wall 76. During the installation of the grid 3 this facilitates the pivoting of the locking bar 45 into the position in which it bears against the opposite wall 80, whereupon the locking bar 45 and the grid 3 can be screwed to one another.

We claim:

1. A drainage channel assembly comprising:

(a) an elongated U-shaped channel body formed of opposing spaced-apart side walls connected on one end to define a closed bottom and open on the opposite end to define an open top;

(b) a rectangular frame for being positioned on the open top of the channel body over and supported by the channel body side walls, wherein the side walls for supporting the frame are provided with outer elevated supporting ribs and inner lower shoulders, and said frame is provided with a lower supporting shoulder at its inner side for supporting side ribs of a grate for being positioned in the rectangular frame;

(c) break lugs carried by said frame and positioned in overlapping relation to the supporting ribs of the side walls of the channel body; the upper part of the side walls of the frame being vertical, with a horizontally protruding side rib which extends above said side wall over the whole length of the frame, which break lugs are attached in a horizontal and protruding manner over said side rib and having at the connecting area between said side rib and said break lugs a predetermined breaking line of reduced thickness to permit removal of the lugs by striking with a sharp blow.

2. A drainage channel assembly according to claim 1, wherein said breaking line of reduced thickness comprises a groove between said break lugs and said frame wall.

* * * * *